US010747153B2

(12) United States Patent
Hongo et al.

(10) Patent No.: US 10,747,153 B2
(45) Date of Patent: Aug. 18, 2020

(54) BELT-TYPE TRANSPORT DEVICE, FIXING DEVICE, AND IMAGE FORMING APPARATUS

(71) Applicant: FUJI XEROX Co., Ltd., Tokyo (JP)

(72) Inventors: Mitsutoshi Hongo, Kanagawa (JP); Kouichi Kimura, Kanagawa (JP); Hideki Kuge, Kanagawa (JP); Kei Tanaka, Kanagawa (JP); Noboru Hirakawa, Kanagawa (JP); Takashi Matsubara, Kanagawa (JP); Takashi Ohashi, Kanagawa (JP); Takashi Ochi, Kanagawa (JP); Toshimasa Toyama, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/517,834

(22) Filed: Jul. 22, 2019

(65) Prior Publication Data

US 2020/0218184 A1 Jul. 9, 2020

(30) Foreign Application Priority Data

Jan. 8, 2019 (JP) ..... 2019-001119

(51) Int. Cl.
*G03G 15/20* (2006.01)

(52) U.S. Cl.
CPC ..... *G03G 15/2053* (2013.01); *G03G 15/2025* (2013.01); *G03G 15/2064* (2013.01); (Continued)

(58) Field of Classification Search
CPC ..... G03G 15/2053; G03G 15/2025; G03G 15/2064; G03G 15/2017; G03G 2215/2009; G03G 2215/2016
See application file for complete search history.

(56) References Cited

U.S. PATENT DOCUMENTS 7,546,078 B2 6/2009 Okuda et al.
2014/0286683 A1* 9/2014 Nakamura ..... G03G 15/2053 399/329

(Continued)

FOREIGN PATENT DOCUMENTS

JP 60-171906 A 9/1985
JP 2007-079067 A 3/2007
JP 2011-048233 A 3/2011

*Primary Examiner* — Sophia S Chen
(74) *Attorney, Agent, or Firm* — Sughrue Mion, PLLC

(57) ABSTRACT

A belt-type transport device includes a belt, a pressure unit, a nip forming unit, a belt stretching roller, an inclination controller, a contact unit, and a support unit. The belt is an endless belt, has an outer circumferential surface and an inner circumferential surface, and is to be rotated. The pressure unit is in contact with the outer circumferential surface of the belt. The nip forming unit presses the belt against the pressure unit so as to form a nip through which a recording medium is to be transported. The belt stretching roller is disposed inside the belt and stretches the belt. The inclination controller controls inclination of the belt stretching roller. The contact unit is provided along a width direction of the belt and is in contact with the inner circumferential surface of the belt. The support unit supports the contact unit such that the contact unit is able to follow inclination of the belt which is changed due to the inclination of the belt stretching roller.

19 Claims, 10 Drawing Sheets

(52) U.S. Cl.
CPC ..... *G03G 2215/2009* (2013.01); *G03G 2215/2016* (2013.01)

(56) References Cited

U.S. PATENT DOCUMENTS

| | | | | |
|---|---|---|---|---|
| 2016/0306306 | A1* | 10/2016 | Nozawa | G03G 15/2053 |
| 2018/0267440 | A1* | 9/2018 | Matsubara | G03G 15/2017 |

* cited by examiner

BELT-TYPE TRANSPORT DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2019-001119 filed Jan. 8, 2019.

BACKGROUND

(i) Technical Field

The present disclosure relates to a belt-type transport device, a fixing device, and an image forming apparatus.

(ii) Related Art

Japanese Unexamined Patent Application Publication No. 2007-079067 discloses an image heating device that includes a correction mechanism and an oil application roller. The correction mechanism swings a belt in a width direction of the belt so as to correct deviation of the belt. The oil application roller is in contact with an inner circumferential surface of the belt. The oil application roller and a roller included in the correction mechanism are supported by an integral frame.

SUMMARY

Aspects of non-limiting embodiments of the present disclosure relate to a belt-type transport device in which, compared to a structure in which the orientation of a contact unit is fixed independently of inclination of a belt stretching roller, variation in contact state of the contact unit in a width direction of a belt is suppressed.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a belt-type transport device including a belt, a pressure unit, a nip forming unit, a belt stretching roller, an inclination controller, a contact unit, and a support unit. The belt is an endless belt, has an outer circumferential surface and an inner circumferential surface, and is to be rotated. The pressure unit is in contact with the outer circumferential surface of the belt. The nip forming unit presses the belt against the pressure unit so as to form a nip through which a recording medium is to be transported. The belt stretching roller is disposed inside the belt and stretches the belt. The inclination controller controls inclination of the belt stretching roller. The contact unit is provided along a width direction of the belt and is in contact with the inner circumferential surface of the belt. The support unit supports the contact unit such that the contact unit is able to follow inclination of the belt which is changed due to the inclination of the belt stretching roller.

BRIEF DESCRIPTION OF THE DRAWINGS

Exemplary embodiments of the present disclosure will be described in detail based on the following figures, wherein.

DETAILED DESCRIPTION

Figure 1:
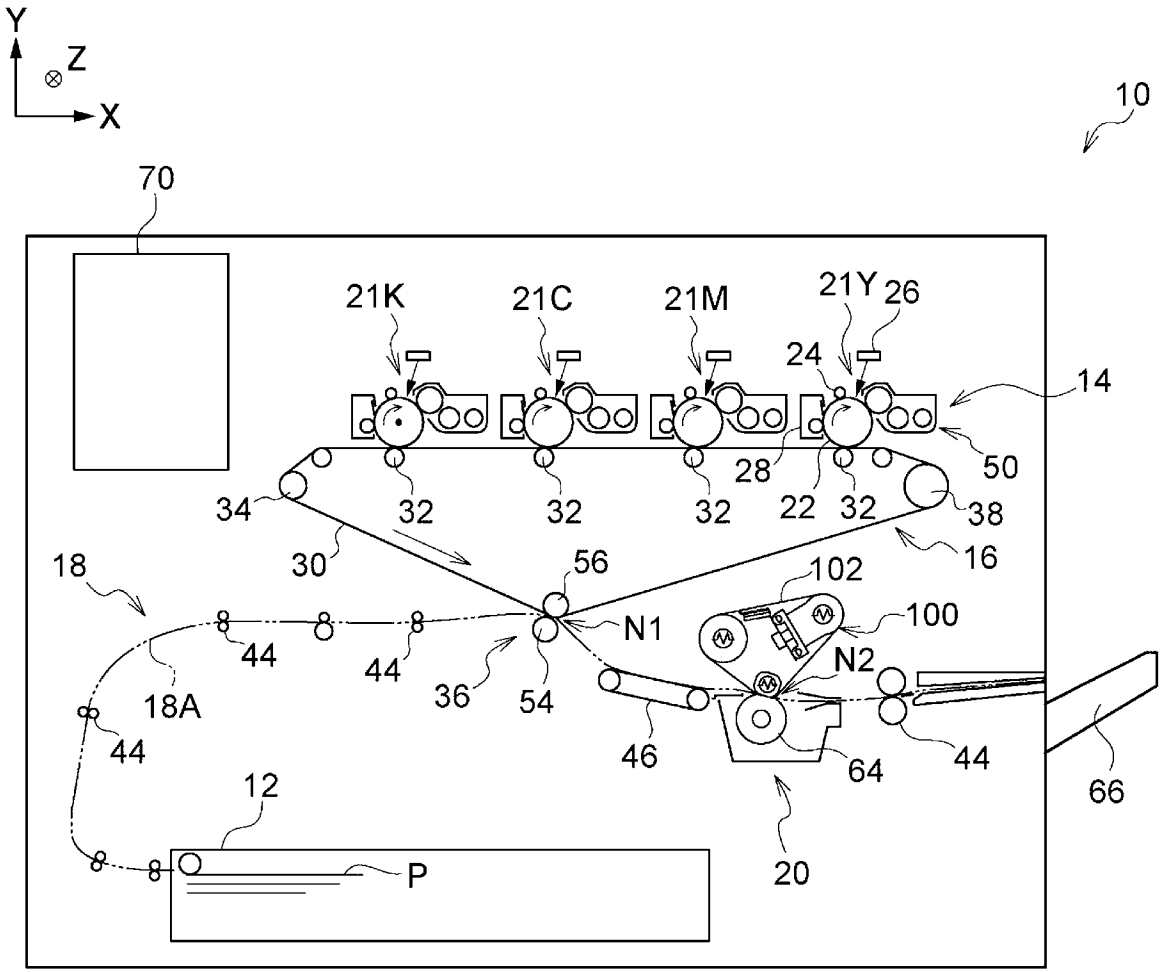
FIG. 1 illustrates the structure of an image forming apparatus including a fixing device according to a first exemplary embodiment.

Exemplary embodiments according to the present disclosure (referred to as "present exemplary embodiment" or "present exemplary embodiments" hereinafter) will be described below. In the following description, a direction indicated by an arrow X in the drawings is referred to as the apparatus width direction and a direction indicated by an arrow Y is referred to as the apparatus height direction. Furthermore, a direction (arrow Z direction) perpendicular to the apparatus width direction and the apparatus height direction is referred to as the apparatus depth direction.

First Exemplary Embodiment

FIG. 1 is an example of an image forming apparatus 10 including a fixing device 20 according to a first exemplary embodiment. First, an image forming apparatus according to the present exemplary embodiment (see FIG. 1) is described. Next, the fixing device 20 is described.

Overall Structure of the Image Forming Apparatus

As illustrated in FIG. 1, the image forming apparatus 10 is an electrophotographic apparatus that includes a recording medium container 12, a toner image forming section 14, a transfer device 16, a recording medium transport device 18, the fixing device 20, and a controller 70.

The recording medium container 12 contains sheets of paper P. Each of the sheets P serves as an example of a recording medium before an image is formed thereon.

The toner image forming section 14 performs charging, exposing, and developing steps so as to form the toner image held by an intermediate transfer belt 30 included in the transfer device 16. The intermediate transfer belt 30 will be described later. The toner image forming section 14 includes, for example, monochrome units 21Y, 21M, 21C, 21K forming, on respective photoconductors 22, toner images with toner of respective different colors, that is, yellow (Y), magenta (M), cyan (C), and black (K). Furthermore, the toner image forming section 14 is able to form a toner image of a plurality of colors in accordance with, for example, image data. Here, the photoconductors 22 each serve as an example of an image holding body.

The monochrome units 21Y, 21M, 21C, 21K are structured similarly to one another or the same as one another other than the colors of the toner images formed by the monochrome units 21Y, 21M, 21C, 21K. In the following description, the alphabetic characters "Y", "M", "C", "K" of the monochrome units 21Y, 21M, 21C, 21K are omitted when neither distinction between the monochrome units 21Y, 21M, 21C, 21K nor distinction between elements of the monochrome units 21Y, 21M, 21C, 21K is required. Each of the monochrome units 21 includes a corresponding one of the photoconductors 22, a corresponding one of chargers 24, a corresponding one of light exposure devices 26, a corresponding one of developing devices 50, and a corresponding one of cleaners 28.

The transfer device 16 holds the toner images formed by the monochrome units 21 and transfers the toner images onto the sheet P. The transfer device 16 includes the intermediate transfer belt 30, four transfer rollers 32, a drive roller 38, a second transfer unit 36, and a tension roller 34. The intermediate transfer belt 30 is an endless belt. A nip is formed between each of the four transfer rollers 32 and a corresponding one of the photoconductors 22 with the intermediate transfer belt 30 interposed therebetween. The intermediate transfer belt 30 is rotated in an arrow direction by the drive roller 38. As an example, the monochrome units 21Y, 21M, 21C, 21K are arranged in this order from the upstream side to the downstream side in the rotating direction of the intermediate transfer belt 30 according to the present exemplary embodiment. Thus, the toner images on the photoconductors 22 formed by the monochrome units 21Y, 21M, 21C, 21K are transferred by the transfer rollers 32 so as to be superposed one another on the intermediate transfer belt 30.

The second transfer unit 36 includes a transfer roller 54 and a facing roller 56. The transfer roller 54 is in contact with a surface of the intermediate transfer belt 30 on which the toner images are held. The facing roller 56 faces the transfer roller 54 with the intermediate transfer belt 30 interposed therebetween. In the second transfer unit 36, the toner images of the colors held by the intermediate transfer belt 30 are transferred onto the sheet P while the sheet P is being transported.

The recording medium transport device 18 transports the sheet P such that the sheet P passes through a nip N1 of the second transfer unit 36 and a nip N2 of the fixing device 20. The recording medium transport device 18 includes a plurality of transport rollers 44 and a transport belt 46. Here, the transport rollers 44 and the transport belt 46 are included in an example of a transport unit. The transport rollers 44 include pairs of rollers. The rollers of each of the pairs are in contact with each other. The transport rollers 44 transport the sheet P contained in the recording medium container 12 along a transport path 18A.

The transport belt 46 is an endless belt looped over a pair of rollers space from each other. The transport belt 46 is disposed downstream of the second transfer unit 36 and upstream of the fixing device 20 in a direction in which the sheet P is transported. The transport belt 46 transports, along the transport path 18A to the fixing device 20, the sheet P onto which the toner images have been transferred by the second transfer unit 36.

The fixing device 20 fixes, at the nip N2, the toner images transferred (through second transfer) onto the sheet P by the transfer device 16. Here, the fixing device 20 serves as an example of a belt-type transport device. The fixing device 20 includes a fixing belt module 100 and a pressure roller 64. The fixing belt module 100 includes a fixing belt 102 serving as an example of an endless belt to be rotated. The pressure roller 64 serves as an example of a pressure unit in contact with the fixing belt 102. When the sheet P is transported to the nip N2 between the fixing belt 102 and the pressure roller 64, the toner images on the sheet P are fixed by heat and pressure. The fixing device 20 will be described later.

The controller 70 controls the components of the image forming apparatus 10. For example, the controller 70 controls the components of the image forming apparatus 10 (that is, causes the components to perform respective operations) in accordance with job data received from an external device. Here, the job data includes image data (image information) for formation of the toner images with the monochrome units 21 and data required for other image forming operations.

Operations of the Image Forming Apparatus

Next, operations of the image forming apparatus 10 are described.

Upon reception of the job data from the external device (not illustrated), the controller 70 causes the toner image forming section 14, the transfer device 16, the recording medium transport device 18, and the fixing device 20 to operate. In the toner image forming section 14, the photoconductors 22 are charged by the respective chargers 24 and the photoconductors 22 are exposed to light emitted by the respective light exposure devices 26. Thus, electrostatic latent images are formed. The electrostatic latent images of the photoconductors 22 are developed by the respective developing devices 50. As a result, toner images are formed on the photoconductors 22.

Next, a voltage (first transfer voltage) is applied to each of the transfer rollers 32 from a power source (not illustrated). Furthermore, the drive roller 38 driven by a drive source (not illustrated) rotates the intermediate transfer belt 30 in the arrow direction. As a result, the toner images of the colors are transferred through first transfer onto the intermediate transfer belt 30 so as to be superposed one another.

Furthermore, at timing adjusted to arrival, at the nip N1, of the toner images of the colors held by the rotating intermediate transfer belt 30, the recording medium transport device 18 feeds the sheet P into the nip N1. In the second transfer unit 36, when a voltage (second transfer voltage) is applied from a power source (not illustrated) to a power supply roller (not illustrated) in contact with an outer circumference of the facing roller 56, the toner images of the colors are transferred through second transfer onto the sheet P passing through the nip N1.

Next, the recording medium transport device 18 feeds into the nip N2 the sheet P onto which the toner images of the colors have been transferred through second transfer. As a result, the toner images of the colors on the sheet P passing through the nip N2 are fixed to the sheet P by the fixing device 20. Thus, an image is formed on the sheet P. After that, the sheet P is output to an output unit 66 by the transport rollers 44.

The Fixing Device

Next, the fixing device 20 is described.

Figure 2:
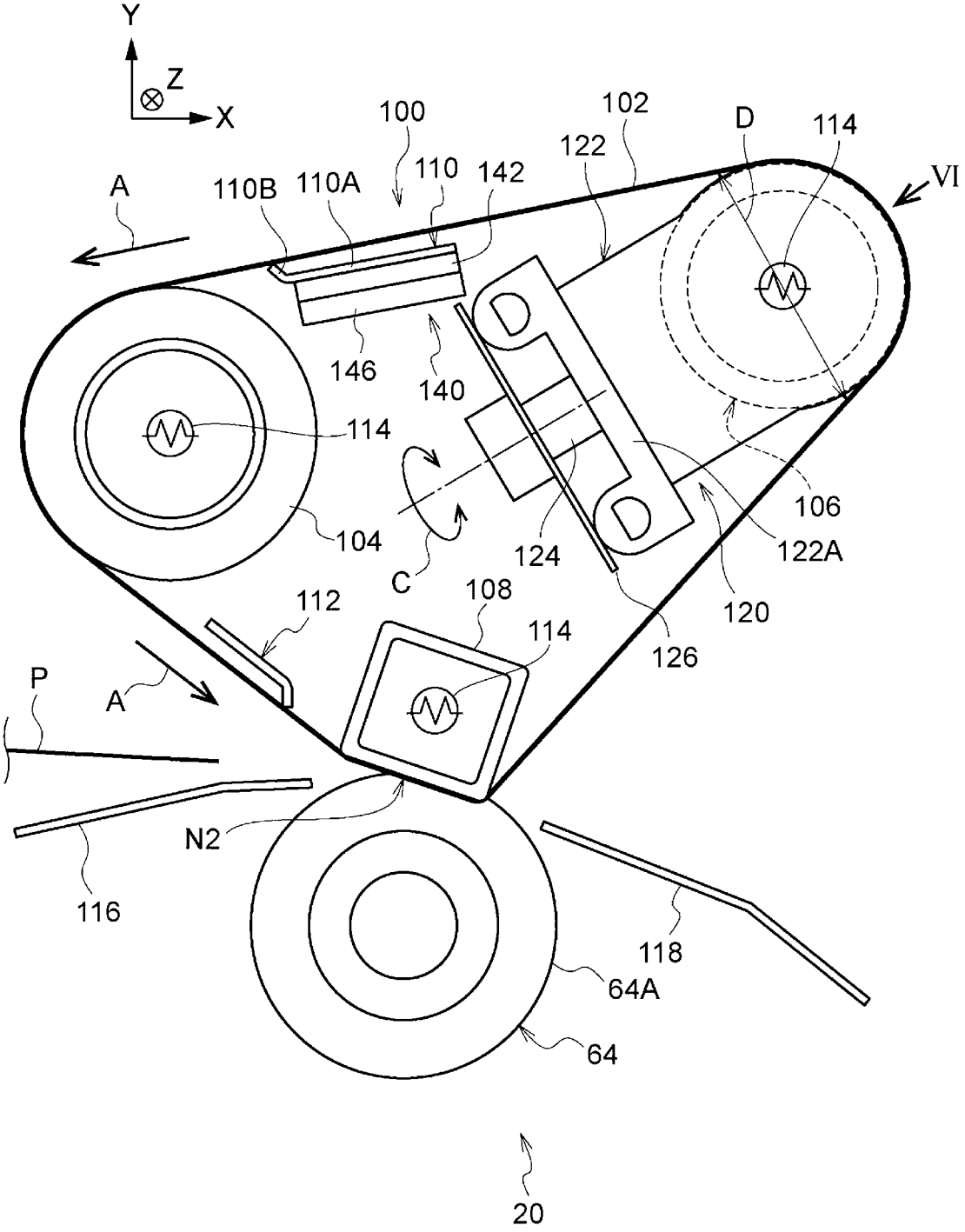
FIG. 2 is a side sectional view of the fixing device according to the first exemplary embodiment.

FIG. 2 is a side sectional view of the fixing device 20. As illustrated in FIG. 2, the fixing device 20 includes, as described above, the fixing belt module 100 and the pressure roller 64 pressed against the fixing belt module 100. The fixing belt module 100 includes the fixing belt 102, a stretching roller 104, and a steering roller 106. The fixing belt 102 is rotated in an arrow A direction. The stretching roller 104 stretches the fixing belt 102 from the inside of the fixing belt 102. The steering roller 106 serves as an example of a belt stretching roller that stretches the fixing belt 102 from the inside of the fixing belt 102. The fixing belt module 100 further includes a load-bearing member 108 serving as an example of a nip forming unit that presses the fixing belt 102 against the pressure roller 64 so as to form the nip N2. The steering roller 106 is disposed, in the rotating direction of the fixing belt 102, upstream of the stretching roller 104 and downstream of the load-bearing member 108.

The fixing belt module 100 further includes a contact member 110 serving as an example of a contact unit in contact with an inner circumferential surface of the fixing belt 102 between the steering roller 106 and the stretching roller 104. In other words, no member is in contact with the fixing belt 102 between the steering roller 106 and the contact member 110. The fixing belt module 100 further includes a lubricator 112 in contact with the inner circumferential surface of the fixing belt 102 between the stretching roller 104 and the load-bearing member 108. The fixing belt module 100 further includes a steering mechanism 120 serving as an example of an inclination controller that controls inclination of the steering roller 106.

Since no member in contact with the fixing belt 102 is provided between the steering roller 106 and the contact member 110, reduction in temperature of the fixing belt 102 may be suppressed compared to the case where a member in contact with the fixing belt is provided between the steering roller and the contact member. That is, the number of members in contact with the fixing belt 102 may be minimized.

In the fixing device 20, part of an outer circumferential surface 64A of the pressure roller 64 is pressed against an outer circumferential surface of the fixing belt 102. The nip N2 is formed at a position where this part of the outer circumferential surface 64A is pressed. The nip N2 where the outer circumferential surface 64A of the pressure roller 64 and the fixing belt 102 are in contact with each other is a passage portion where the sheet P on which the toner images have been formed passes through while being subjected to pressure and heat. In the fixing device 20, when pressure and heat are applied to the sheet P passing through the nip N2 where the outer circumferential surface 64A of the pressure roller 64 and the fixing belt 102 are in contact with each other, the toner images are fixed to the sheet P.

The sheet P entering the nip N2 has a toner image forming side where the toner images have been formed. According to the present exemplary embodiment, the sheet P enters the nip N2 while the toner image forming side faces upward in FIG. 2. Thus, according to the present exemplary embodiment, the toner image forming side of the sheet P is brought into contact with the fixing belt 102.

According to the present exemplary embodiment, the pressure roller 64 is rotated by a motor (not illustrated), and the fixing belt 102 follows the rotation of the pressure roller 64, thereby the fixing belt 102 is rotated. That is, the fixing belt 102 is rotated (circularly moved) in the arrow A direction in FIG. 2 by being subjected to a drive force from the rotating pressure roller 64.

The stretching roller 104 and the steering roller 106 are rotatably supported and support the fixing belt 102 such that the fixing belt 102 is rotatable. The load-bearing member 108 is disposed at a position facing the pressure roller 64 with the fixing belt 102 interposed therebetween and subjected to a load from the pressure roller 64. The pressure roller 64 includes an elastically deformable layer in or near the outer circumferential surface 64A thereof. When the pressure roller 64 is brought into contact with the load-bearing member 108 with the fixing belt 102 interposed therebetween, the pressure roller 64 is recessed at the nip N2. According to the present exemplary embodiment, the pressure roller 64 and the load-bearing member 108 apply the pressure to the sheet P interposed therebetween.

According to the present exemplary embodiment, heaters 114 are provided in the stretching roller 104, the steering roller 106, and the load-bearing member 108. The heaters 114 each serve as an example of a heating unit and heats the stretching roller 104, the steering roller 106, and the load-bearing member 108. Here, the heater 114 includes, for example, a halogen heater.

The steering mechanism 120 displaces (that is, changes the inclination of) the steering roller 106. According to the present exemplary embodiment, the steering roller 106 is inclined, by using the steering mechanism 120, relative to a state in which the steering roller 106 is parallel to the stretching roller 104, and as the steering roller 106 is inclined, the fixing belt 102 is moved in a width direction of the fixing belt 102. Thus, according to the present exemplary embodiment, the position of the fixing belt 102 in the width direction of the fixing belt 102 is adjusted, and the fixing belt 102 is rotated along a predetermined intended path. The steering mechanism 120 will be described later.

The lubricator 112 supplies a lubricant such as oil to the inner circumferential surface of the fixing belt 102. Felt (not illustrated) is bonded at least to a surface of the lubricator 112 near or on the fixing belt 102. The felt is impregnated with the lubricant. The lubricator 112 is disposed in the width direction of the fixing belt 102. In some cases, powder produced from wear adheres to the inner circumferential surface of the fixing belt 102 at the nip N2. However, since the lubricator 112 is in contact with the inner circumferential surface of the fixing belt 102, the powder produced from wear and adhering to the fixing belt 102 is removed (that is, the inner circumferential surface of the fixing belt 102 is cleaned). The lubricator 112 is disposed, in the rotating direction of the fixing belt 102, downstream of the stretching roller 104 and upstream of the load-bearing member 108.

Likewise, the contact member 110 supplies a lubricant such as oil to the inner circumferential surface of the fixing belt 102. Felt (not illustrated) is bonded at least to a surface of the contact member 110 near or on the fixing belt 102. The felt is impregnated with the lubricant. The contact member 110 is disposed in the width direction of the fixing belt 102. Furthermore, since the contact member 110 is in contact with the inner circumferential surface of the fixing belt 102, the powder produced from wear and adhering to the fixing belt 102 is removed (that is, the inner circumferential surface of the fixing belt 102 is cleaned). The contact member 110 is disposed, in the rotating direction of the fixing belt 102, upstream of the stretching roller 104 and downstream of the steering roller 106.

When the inclination of the steering roller 106 is changed by using the steering mechanism 120, inclination of the fixing belt 102 is changed. The fixing belt module 100 is provided with a support device 140 serving as an example of a support unit. The support device 140 supports the contact member 110 such that the contact member 110 is able to follow the inclination of the fixing belt 102. The support device 140 will be described later.

The fixing device 20 is provided with a first sheet guide member 116 disposed upstream of the nip N2 in the transport direction of the sheet P. The first sheet guide member 116 guides the sheet P transported to the nip N2. The first sheet guide member 116 supports the sheet P from below so as to guide the sheet P to the nip N2. The fixing device 20 is also provided with a second sheet guide member 118 disposed downstream of the nip N2. The second sheet guide member 118 guides downstream the sheet P transported from the nip N2. The second sheet guide member 118 also supports the sheet P from below so as to guide the sheet P downstream.

Figure 4:
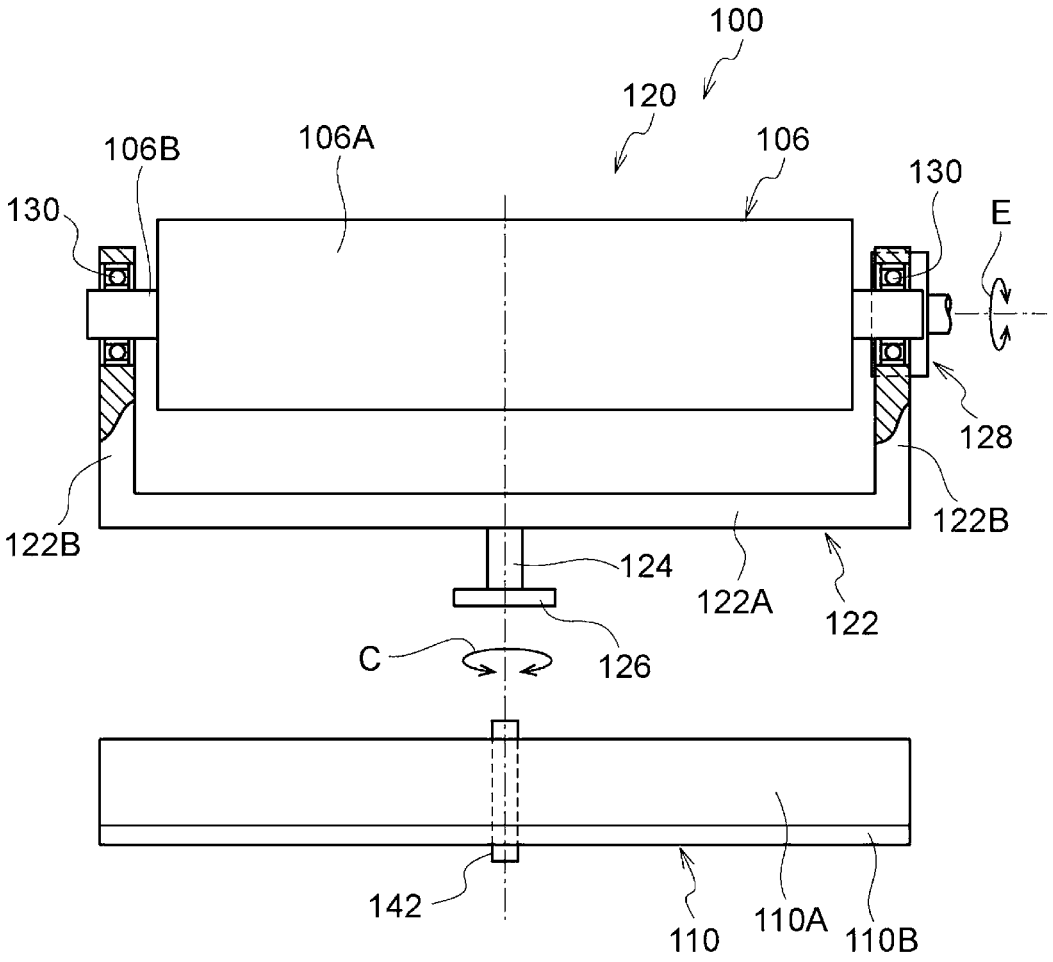
FIG. 4 illustrates the structure of a steering mechanism used for the fixing device according to the first exemplary embodiment seen in a direction intersecting the axial direction of a steering roller.
Figure 5:
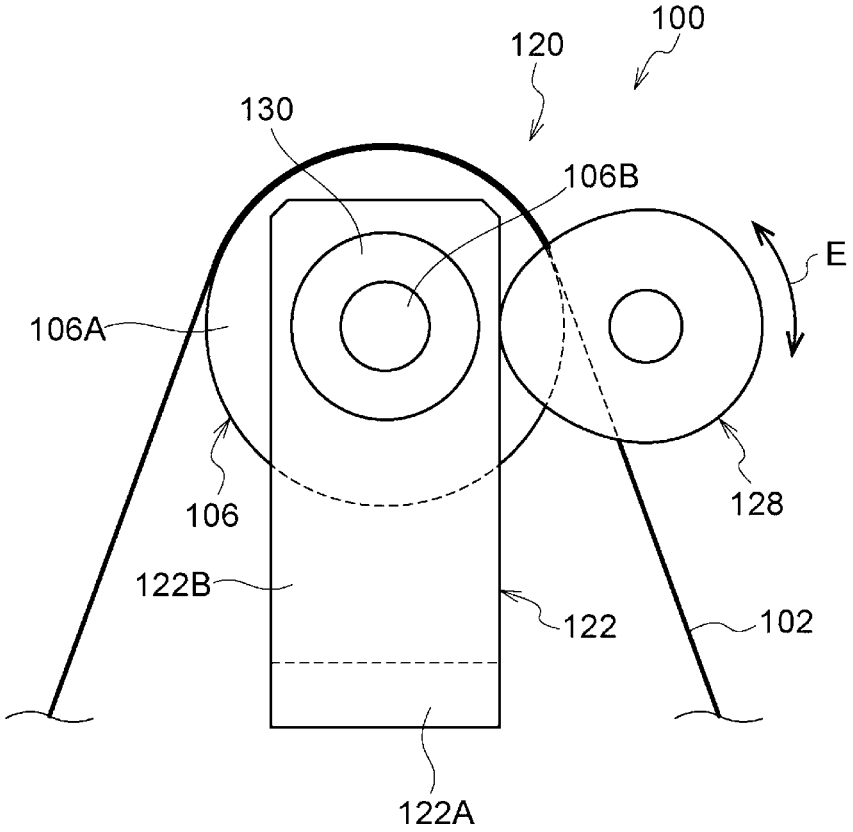
FIG. 5 is a front view of the steering mechanism used for the fixing device according to the first exemplary embodiment.

FIG. 4 illustrates the structure of the steering mechanism 120 seen in a direction intersecting the axial direction of the steering roller 106. In FIG. 4, the steering roller 106 and the contact member 110 in developed states are schematically illustrated. FIG. 5 is a front view of the steering mechanism 120 seen in the axial direction of the steering roller 106.

As illustrated in FIGS. 4 and 5, the steering mechanism 120 includes a frame 122, a rotation shaft 124, and a support 126 (see FIG. 2). The steering roller 106 is rotatably supported by the frame 122. The rotation shaft 124 is for rotation of the frame 122. The rotation shaft 124 is rotatably supported by the support 126. The steering mechanism 120 further includes a cam 128 in contact with one end portion of the frame 122 in a width direction of the frame 122.

The steering roller 106 includes a cylindrical portion 106A and a shaft portion 106B disposed at a central portion of the cylindrical portion 106A. The frame 122 has a U shape seen in the direction intersecting the axial direction of the steering roller 106 (see FIG. 4). More specifically, the frame 122 has a bottom portion 122A and side portions 122B. The bottom portion 122A is disposed in the axial direction of the steering roller 106. The side portions 122B are disposed on both sides of the bottom portion 122A in a width direction of the bottom portion 122A. The shaft portion 106B of the steering roller 106 is rotatably supported at the side portions 122B on both the sides of the frame 122 in the width direction of the frame 122 with bearings 130 interposed therebetween.

The rotation shaft 124 is connected to a central portion of the bottom portion 122A of the frame 122 in the width direction of the frame 122. The position of the rotation shaft 124 corresponds to a central portion of the fixing belt 102. The rotation shaft 124 is disposed in a direction intersecting a longitudinal direction of the bottom portion 122A and allows the frame 122 to be rotated thereabout as indicated by arrows C.

The cam 128 is disposed at one of the side portions 122B of the frame 122 in the width direction of the frame 122 so as to be in contact with the side portion 122B. The axial direction of the cam 128 is oriented in the direction of the shaft portion 106B of the steering roller 106. The cam 128 is in contact with an end surface of the side portion 122B of the frame 122 (that is, an end surface intersecting a side surface of the side portion 122B). The cam 128 is rotated by a motor (not illustrated). When the cam 128 is rotated in arrow E directions, the frame 122 is swung (that is, the frame 122 is rotated about the rotation shaft 124) in accordance with the rotational position of the cam 128. Thus, end portions of the steering roller 106 in a width direction of the steering roller 106 swing in arrow D directions (see FIG. 2). This changes the inclination of the steering roller 106.

Figure 6:
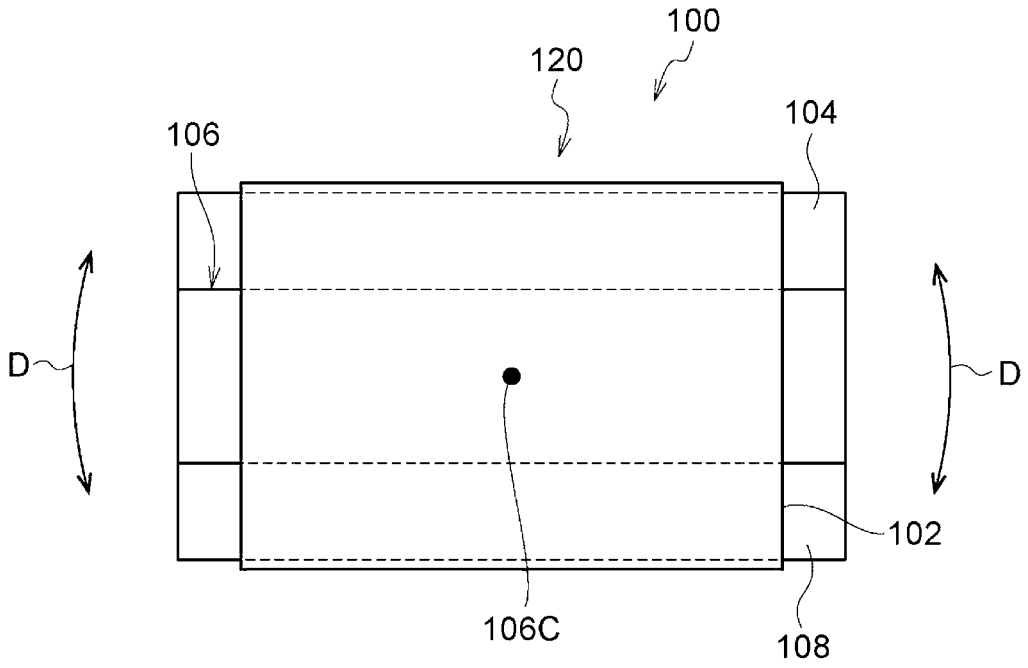
FIG. 6 is a plan view of a fixing belt and the steering roller.

FIG. 6 schematically illustrates the fixing belt module 100 seen in an arrow VI direction illustrated in FIG. 2. As illustrated in FIG. 6, the steering mechanism 120 swings, in the arrow D directions, the end portions of the steering roller 106 in the width direction of the steering roller 106 about a central portion 106C in the axial direction of the steering roller 106. Here, the central portion 106C in the axial direction of the steering roller 106 is the axis of the rotation shaft 124 illustrated in FIG. 2. Thus, the inclination of the steering roller 106 is changed. When the steering roller 106 is inclined, the fixing belt 102 is moved toward one of the end portions of the steering roller 106 in the axial direction of the steering roller 106. Along with this movement of the fixing belt 102, the position of the fixing belt 102 in the width direction of the fixing belt 102 is changed. The fixing belt module 100 is provided with a belt position sensor (not illustrated) that detects the position of the fixing belt 102 in the width direction of the fixing belt 102. The controller 70 causes the inclination of the steering roller 106 to be fed back in accordance with a detection signal of the belt position sensor.

Figure 3A:
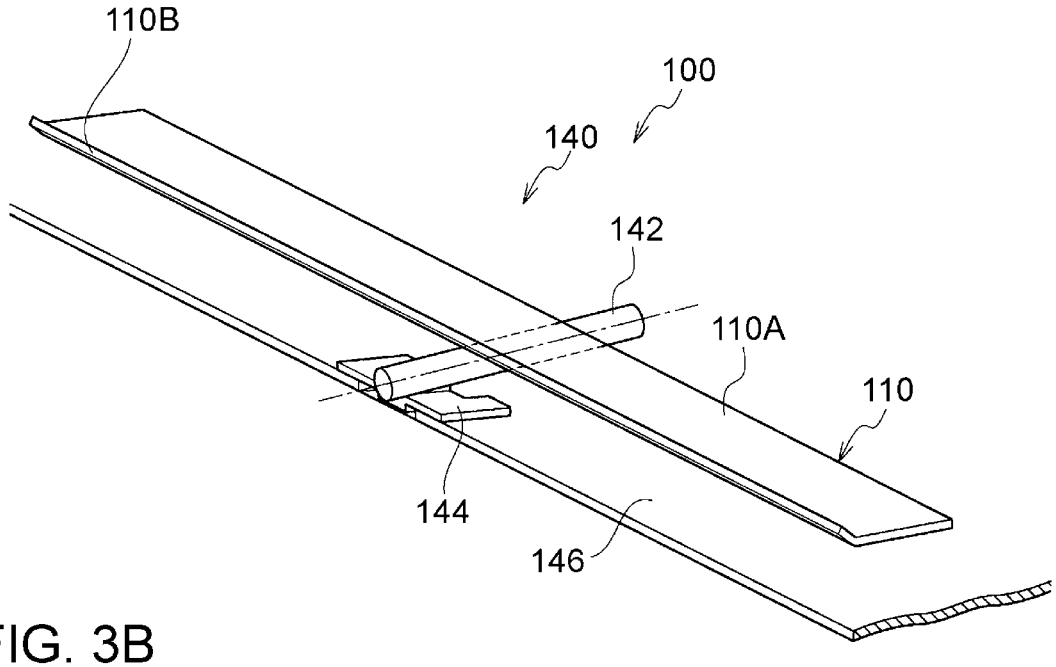
FIG. 3A is a perspective view of a support device of a contact member used for the fixing device according to the first exemplary embodiment.
Figure 3B:
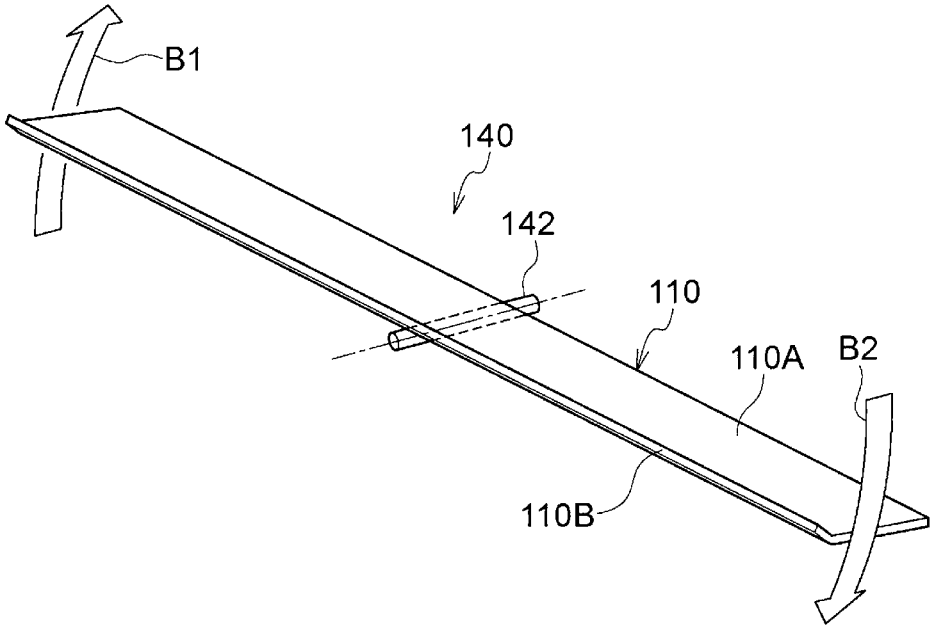
FIG. 3B is a perspective view illustrating an operation of the contact member.

FIGS. 3A and 3B are perspective views of the support device 140 of the contact member 110. As illustrated in FIGS. 3A and 3B, the support device 140 includes a cylindrical shaft 142 and a plate-shaped frame 146. The shaft 142 is in contact with a central portion of the contact member 110 in a width direction (longitudinal direction) of the contact member 110. The frame 146 supports the shaft 142. The support device 140 also includes an attachment 144 with which the shaft 142 is attached to the frame 146. The attachment 144 has a recess in contact with an outer circumferential surface of the shaft 142. The shaft 142 is secured to the frame 146 with the attachment 144 by inserting the shaft 142 into the recess of the attachment 144. The shaft 142 extends in a direction intersecting the width direction of the contact member 110.

The contact member 110 includes a plate-shaped portion 110A having a rectangular shape and a projection 110B extending in a longitudinal direction of the plate-shaped portion 110A at an end portion of the plate-shaped portion 110A. The projection 110B projects in a direction intersecting a surface direction of the plate-shaped portion 110A, that is, the projection 110B obliquely projects from the plate-shaped portion 110A. The projection 110B of the contact member 110 is in contact with the inner circumferential surface of the fixing belt 102 (see FIG. 2).

The support device 140 causes the contact member 110 to be swung about the shaft 142 at the central portion of the contact member 110 in the width direction of the contact member 110. According to the present exemplary embodiment, the contact member 110 is in contact with an outer circumferential surface of the shaft 142 and swung, for example, in arrow B1, B2 directions along the outer circumferential surface of the shaft 142.

In the fixing belt module 100, when the inclination of the steering roller 106 is changed by using the steering mechanism 120, inclination of the fixing belt 102 is changed. The contact member 110 is supported by the shaft 142 of the support device 140 such that the contact member 110 is able to follow the inclination of the fixing belt 102. The support device 140 causes the contact member 110 to follow the fixing belt 102 in a movement independently of the steering roller 106.

As illustrated in FIG. 2, in the fixing belt module 100, the shaft 142 for the swing of the contact member 110 and the rotation shaft 124 for the inclination of the steering roller 106 are disposed one above the other in a virtual plane illustrated in FIG. 2. According to the present exemplary embodiment, the rotation shaft 124 for the inclination of the steering roller 106 is disposed below the shaft 142 in the virtual plane passing through the center of the shaft 142. In more detail, the entirety of the rotation shaft 124, in the axial direction of the rotation shaft 124, for the inclination of the steering roller 106 is disposed below in the virtual plane passing through the center of the shaft 142. In so doing, the axial direction of the shaft 142 for the swing of the contact member 110 and the axial direction of the rotation shaft 124 for changes in the inclination of the steering roller 106 intersect each in the Z direction illustrated in FIG. 2.

According to the present exemplary embodiment, the contact member 110 is in contact with the shaft 142 and swung along the outer circumferential surface of the shaft 142. Alternatively, the contact member 110 may be coupled to the shaft. In this case, the contact member 110 is rotated about the shaft so as to be swung.

Operations

Next, operations according to the present exemplary embodiment are described.

The fixing device 20 is provided with the steering mechanism 120 that controls the inclination of the steering roller 106. When the inclination of the steering roller 106 is changed by using the steering mechanism 120, the inclination of the fixing belt 102 is changed due to the inclination of the steering roller 106. The fixing device 20 is provided with the support device 140 that supports the contact member 110 such that the contact member 110 is able to follow the inclination of the fixing belt 102. According to the present exemplary embodiment, the support device 140 causes the contact member 110 to be swung about the shaft 142 at the central portion of the contact member 110 in the width direction of the contact member 110. Thus, when the inclination of the fixing belt 102 is changed, the shaft 142 of the support device 140 allows the contact member 110 to be swung such that the contact member 110 follows the inclination of the fixing belt 102.

For example, with a structure in which the contact member is directly attached to the frame, when the inclination of the fixing belt 102 is changed, a portion of the fixing belt 102 in the width direction of the fixing belt 102 may be brought out of contact from the contact member or a portion of the fixing belt 102 in the width direction of the fixing belt 102 may be strongly pressed against the contact member.

In the above-described fixing device 20, when the inclination of the fixing belt 102 is changed, the contact member 110 is swung such that the contact member 110 follows the inclination of the fixing belt 102. Accordingly, in the fixing device 20, compared to the structure in which the orientation of the contact member is fixed independently of the inclination of the steering roller, variation in contact state of the contact member 110 in the width direction of the fixing belt 102 may be suppressed.

Furthermore, the steering mechanism 120 swings the steering roller 106, and the support device 140 causes the contact member 110 to follow the fixing belt 102 in a movement independently of the steering roller 106 in the fixing device 20. Accordingly, in the fixing device 20, compared to a structure in which the contact member is swung integrally with the steering roller, variation in contact state of the contact member 110 in the width direction of the fixing belt 102 may be suppressed.

Furthermore, in the fixing device 20, the support device 140 causes the contact member 110 to be swung about the central portion of the contact member 110 in the width direction (longitudinal direction) of the contact member 110. Accordingly, in the fixing device 20, compared to a structure in which the entirety of the contact member is moved, variation in contact state of the contact member 110 in the width direction of the fixing belt 102 may be suppressed. Furthermore, in the fixing device 20, compared to a structure in which the contact member is swung about a portion other than the central portion in the width direction (longitudinal direction), the contact member 110 may be easily swung in accordance with changes in the inclination of the fixing belt 102.

Furthermore, in the fixing device 20, the support device 140 includes the shaft 142 about which the contact member 110 is swung, and the shaft 142 extends in a direction intersecting the width direction (longitudinal direction) of the contact member 110. Thus, the contact member 110 is swung about the shaft 142 at the central portion of the contact member 110 in the width direction of the contact member 110. Accordingly, in the fixing device 20, compared to a structure in which the contact member is swung while being supported by a spherical member, movement of the contact member 110 other than swinging in accordance with changes in the inclination of the fixing belt 102 may be limited.

Furthermore, in the fixing device 20, the shaft 142 for the swing of the contact member 110 and the rotation shaft 124 for the inclination of the steering roller 106 are disposed one above the other in the virtual plane illustrated in FIG. 2. Thus, when the inclination of the fixing belt 102 is changed due to the inclination of the steering roller 106, the contact member 110 may be easily moved such that the contact member 110 follows the inclination of the fixing belt 102. Accordingly, in the fixing device 20, compared to a structure in which the rotation shaft for the inclination of the steering roller is disposed at a position out of the virtual plane passing through the shaft, variation in contact state of the contact member 110 in the width direction of the fixing belt 102 may be suppressed.

Second Exemplary Embodiment

Figure 7:
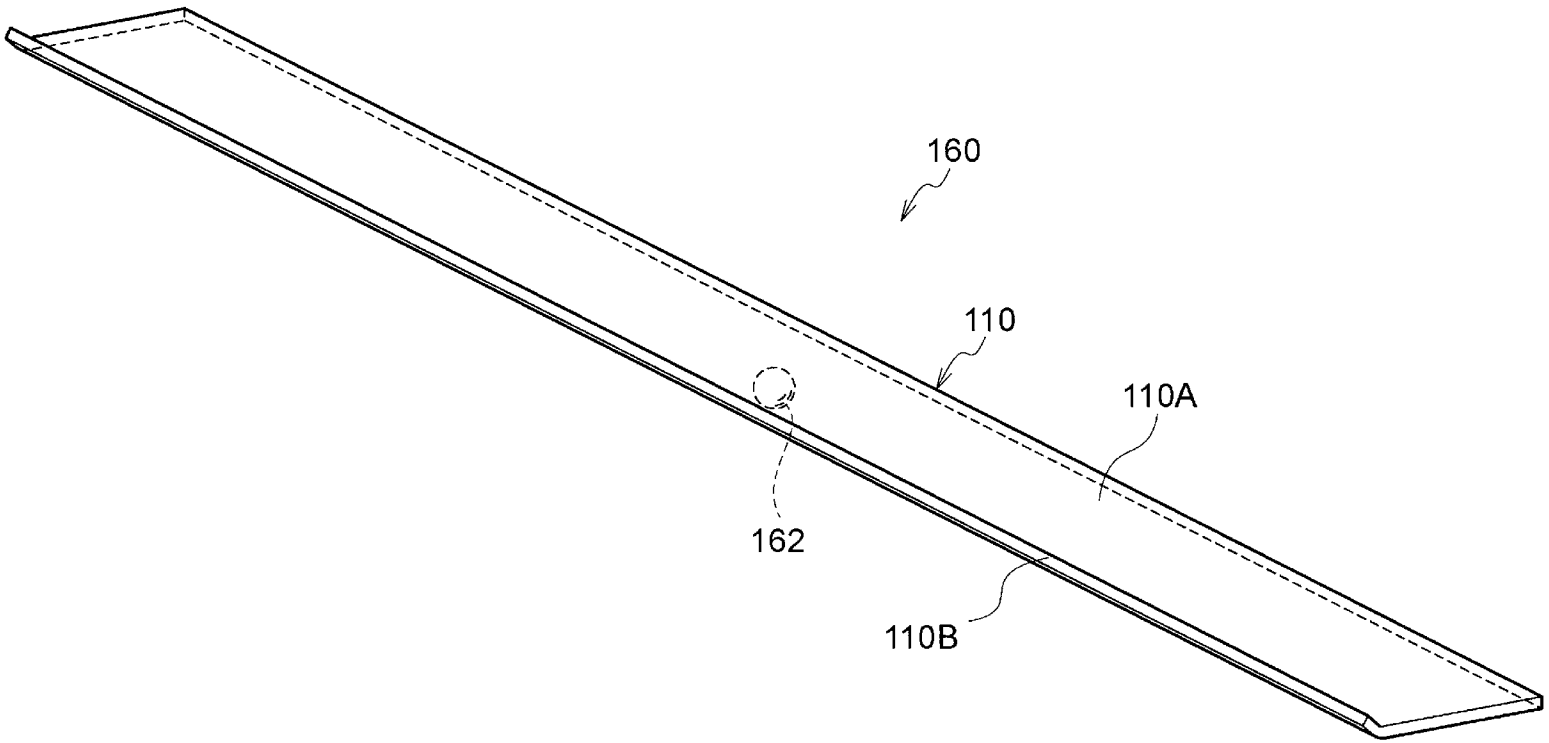
FIG. 7 is a perspective view of a support device of a contact member used for a fixing device according to a second exemplary embodiment.

FIG. 7 illustrates a support device used for a fixing device according to a second exemplary embodiment. The same elements as the elements according to the first exemplary embodiment are denoted by the same reference signs, thereby the description thereof is omitted.

As illustrated in FIG. 7, a support device 160 includes a spherical body 162 in contact with the central portion of the contact member 110 in the width direction (longitudinal direction) of the contact member 110. Here, the support device 160 is an example of the support unit. The spherical body 162 is disposed at a central portion of the contact member 110 in a direction intersecting the width direction (longitudinal direction) of the contact member 110.

Although it is not illustrated, the spherical body 162 is secured to a frame by an attachment. According to the present exemplary embodiment, the contact member 110 is in contact with an outer circumferential surface of the spherical body 162 and swung along the outer circumferential surface of the spherical body 162. Thus, both sides of the contact member 110 in the width direction of the contact member 110 are swung about the spherical body 162 at the central portion of the contact member 110 in the width direction of the contact member 110.

According to the present exemplary embodiment, the structure of the fixing device is the same as the structure of the fixing device 20 according to the first exemplary embodiment (see FIGS. 2, 3A, and 3B) except for the support device 160.

With the above-described support device 160, when the inclination of the fixing belt 102 is changed due to a change in the inclination of the steering roller 106 (see FIG. 2), the spherical body 162 of the support device 160 allows the contact member 110 to be swung such that the contact member 110 follows the inclination of the fixing belt 102.

Accordingly, in the fixing device including the above-described support device 160, compared to the structure in which the orientation of the contact member is fixed independently of the inclination of the steering roller, variation in contact state of the contact member 110 in the width direction of the fixing belt 102 may be suppressed. Furthermore, in the fixing device including the above-described support device 160, operations may be performed similarly to or in the same manner as those of the fixing device 20 according to the first exemplary embodiment with the structure similar to or the same as that of the fixing device 20 according to the first exemplary embodiment. Since the contact member 110 is swung along the spherical body 162, operations achieved when the contact member 110 is swung along the shaft 142 illustrated in FIGS. 3A and 3B are not necessarily achieved.

Third Exemplary Embodiment

Figure 8:
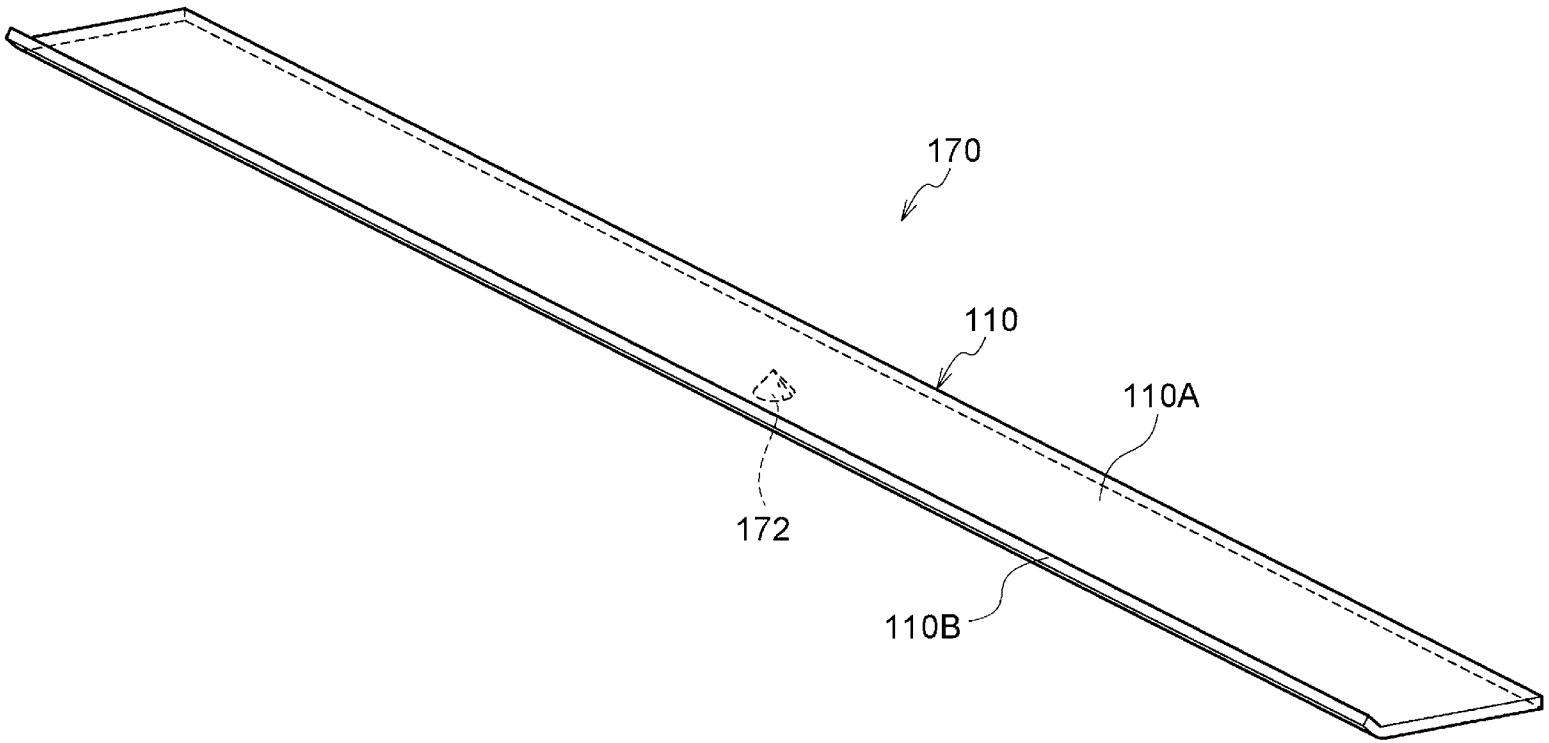
FIG. 8 is a perspective view of a support device of a contact member used for a fixing device according to a third exemplary embodiment.

FIG. 8 illustrates a support device used for a fixing device according to a third exemplary embodiment. The same elements as the elements according to the above-described first and second exemplary embodiments are denoted by the same reference signs, thereby the description thereof is omitted.

As illustrated in FIG. 8, a support device 170 includes a triangular support body 172 in contact with the central portion of the contact member 110 in the width direction (longitudinal direction) of the contact member 110. Here, the support device 170 is an example of the support unit. According to the present exemplary embodiment, the support body 172 has a conical shape. The support body 172 is disposed at the central portion of the contact member 110 in a direction intersecting the width direction (longitudinal direction) of the contact member 110. Although it is not illustrated, the support body 172 is secured to a frame by an attachment. According to the present exemplary embodiment, the contact member 110 is in contact with an apex of the support body 172 and swung while being in contact with the apex of the support body 172. Thus, both the sides of the contact member 110 in the width direction of the contact member 110 are swung about the apex of the support body 172 at the central portion of the contact member 110 in the width direction of the contact member 110.

According to the present exemplary embodiment, the structure of the fixing device is the same as the structure of the fixing device 20 according to the first exemplary embodiment (see FIGS. 2, 3A, and 3B) except for the support device 170.

With the above-described support device 170, when the inclination of the fixing belt 102 is changed due to a change in the inclination of the steering roller 106 (see FIG. 2), the support body 172 of the support device 170 allows the contact member 110 to be swung such that the contact member 110 follows the inclination of the fixing belt 102.

Accordingly, in the fixing device including the above-described support device 170, compared to the structure in which the orientation of the contact member is fixed independently of the inclination of the steering roller, variation in contact state of the contact member 110 in the width direction of the fixing belt 102 may be suppressed. Furthermore, in the fixing device including the above-described support device 170, operations may be performed similarly to or in the same manner as those of the fixing device 20 according to the first exemplary embodiment with the structure similar to or the same as that of the fixing device 20 according to the first exemplary embodiment. Since the contact member 110 is swung while being in contact with the apex of the support body 172, operations achieved when the contact member 110 is swung along the shaft 142 illustrated in FIGS. 3A and 3B are not necessarily achieved.

Fourth Exemplary Embodiment

Figure 9:
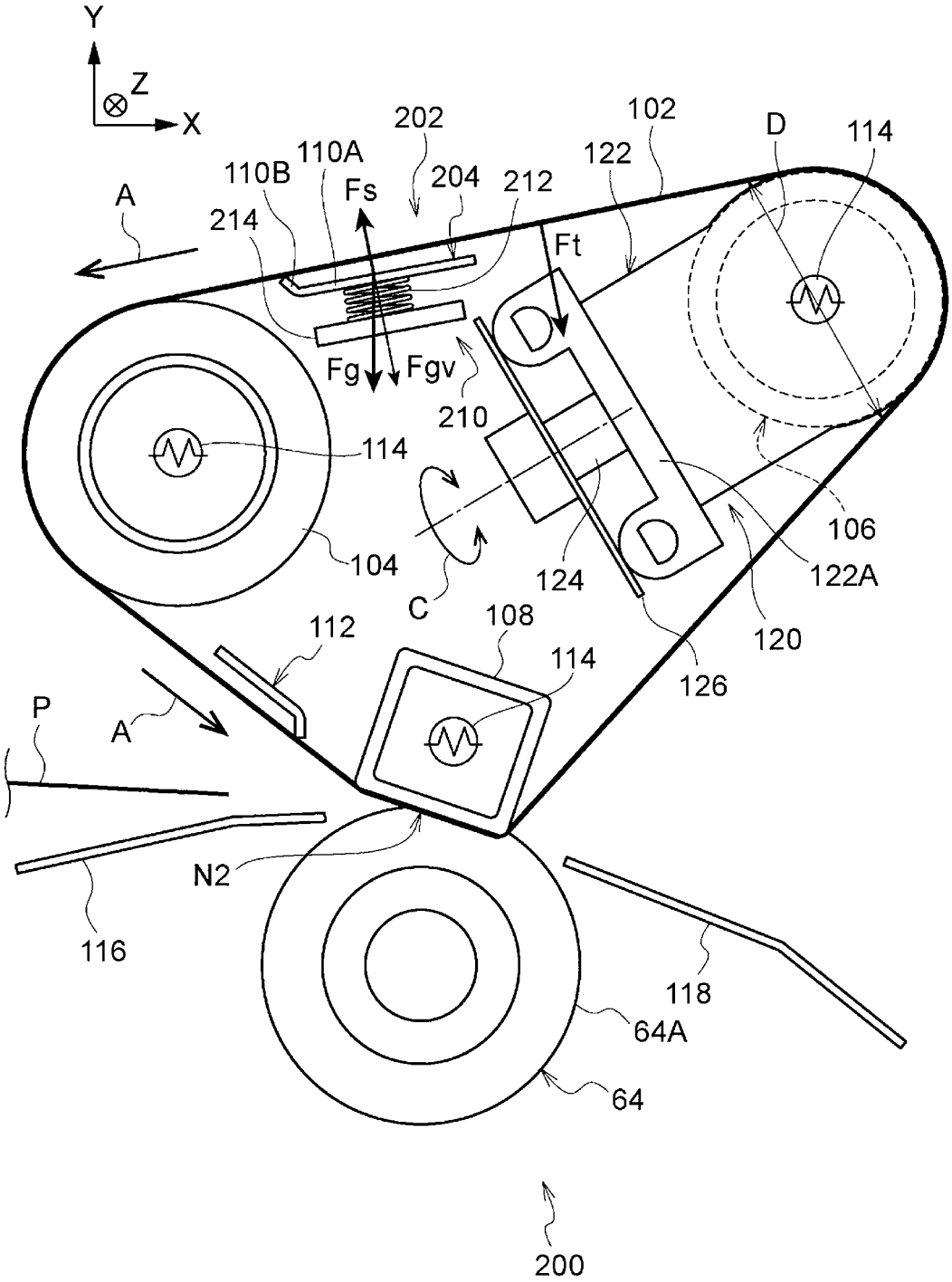
FIG. 9 is a side sectional view of a fixing device according to a fourth exemplary embodiment.
Figure 10A:
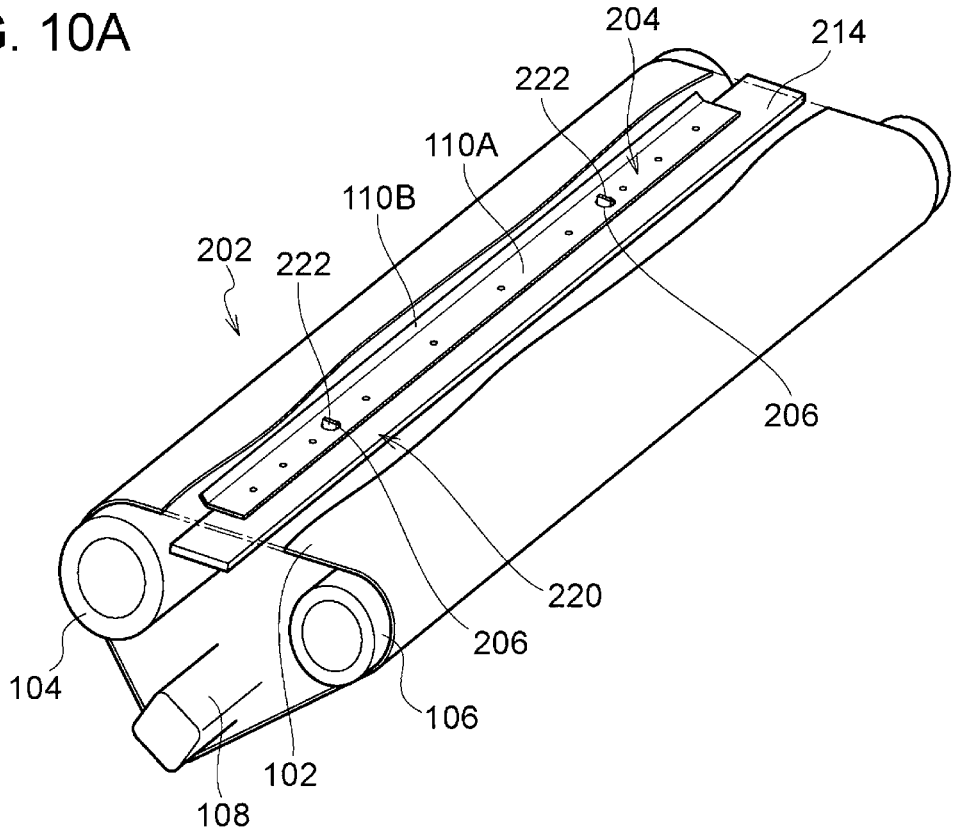
FIG. 10A is a perspective view of a support device of a contact member used for the fixing device according to the fourth exemplary embodiment.
Figure 10B:
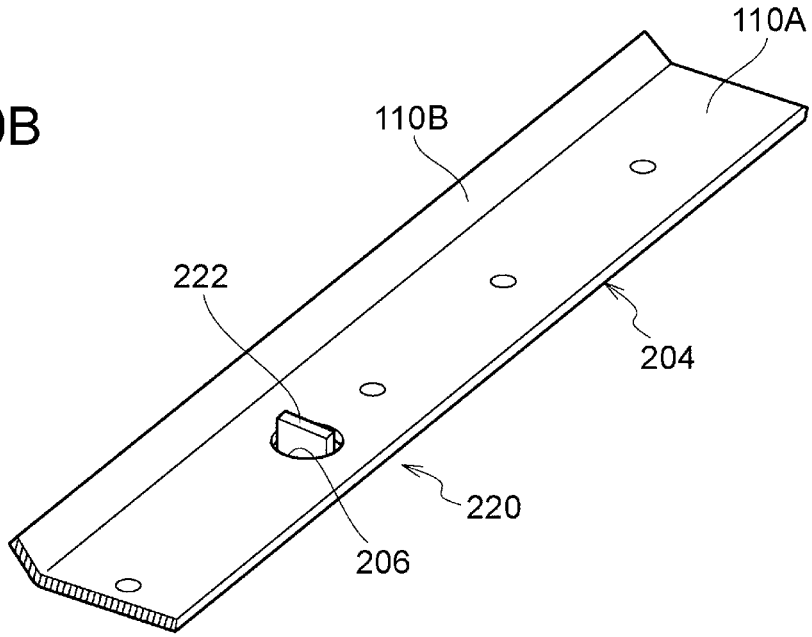
FIG. 10B is a perspective view illustrating guides of the support device.

FIGS. 9, 10A, and 10B illustrate a fixing device according to a fourth exemplary embodiment. The same elements as the elements according to the above-described first and second exemplary embodiments are denoted by the same reference signs, thereby the description thereof is omitted.

As illustrated in FIG. 9, a fixing device 200 includes a fixing belt module 202. Here, the fixing device 200 serves as an example of the belt-type transport device. The fixing belt module 202 includes a contact member 204 serving as an example of the contact unit in contact with the inner circumferential surface of the fixing belt 102 between the steering roller 106 and the stretching roller 104. The contact member 204 includes the plate-shaped portion 110A and the projection 110B extending in the longitudinal direction of the plate-shaped portion 110A at the end portion of the plate-shaped portion 110A.

The fixing belt module 202 is provided with a support device 210 serving as an example of the support unit. The support device 210 supports the contact member 204 such that the contact member 204 is able to follow the inclination of the fixing belt 102. The support device 210 includes coil springs 212 and a frame 214. The coil springs 212 each serve as an example of an urging device and urge the contact member 204 toward (that is, presses the contact member 204 against) the inner circumferential surface of the fixing belt 102. The frame 214 has a plate shape and supports the coil springs 212. One end portion of each of the coil springs 212 is attached to the plate-shaped portion 110A of the contact member 204 and the other end portion of the coil spring 212 is attached to the frame 214. According to the present exemplary embodiment, a plurality of (for example, three of) the coil springs 212 are provided so as to be spaced from one another in a width direction of the contact member 204. The number of the coil springs 212 may be changed. For example, the support device 210 may include a single coil spring 212 or two coil springs 212.

As illustrated in FIGS. 10A and 10B, the support device 210 is provided with a regulating section 220 serving as an example of a regulator. The regulating section 220 regulates movement of the contact member 204 in directions other than an urging direction of the coil springs 212. The regulating section 220 includes holes 206 formed in the plate-shaped portion 110A of the contact member 204 and plate-shaped guides 222 that are attached to the frame 214 and inserted into the holes 206. The guides 222 project from a surface of the frame 214. According to the present exemplary embodiment, two of the holes 206 and two of the guides 222 are disposed in the width direction of the contact member 204. The numbers of the holes 206 and the guides 222 may be changed.

With the support device 210, the contact member 204 is moved, due to the urging force applied by the coil springs 212, in a direction in which the contact member 204 approaches the frame 214 or is spaced from the frame 214 with the guides 222 inserted into the holes 206 of the contact member 204. This regulates the movement of the contact member 204 in directions other than the urging direction of the coil springs 212. That is, the contact member 204 is movable in a direction intersecting (according to the present exemplary embodiment, in a direction perpendicular to or in a direction substantially perpendicular to) the surface of the fixing belt 102. The movement of the contact member 204 may be inclined without a determined central position.

As illustrated in FIG. 9, in the fixing belt module 202, the sum of a largest value of the urging force applied by the coil springs 212 (arrow Fs) and a vector value of the mass of the contact member 204 (arrow Fg; according to the present exemplary embodiment, a vertical component Fgv of the mass of the contact member 204 with respect to the fixing belt 102) is smaller than or equal to tension (arrow Ft) of the fixing belt 102. The contact member 204 is urged toward the fixing belt 102 by the coil springs 212 so as to satisfy the above-described relationship (that is, $Ft \geq Fs+Fgv$) in the entirety in the width direction of the contact member 204. The urging force applied by the coil springs 212 corresponds to a pressing force (that is, the amount of pressing) applied to the fixing belt 102 through the projection 110B of the contact member 204. As the urging force applied by the coil springs 212 increases, the pressing force applied to the fixing belt 102 through the projection 110B of the contact member 204 increases.

In the above-described fixing device 200, when the inclination of the fixing belt 102 is changed due to the inclination of the steering roller 106, the contact member 204 is moved due to the extension and contraction of the coil springs 212 such that the contact member 204 follows the inclination of the fixing belt 102. Accordingly, in the fixing device 200, compared to the structure in which the orientation of the contact member is fixed independently of the inclination of the steering roller, variation in contact state of the contact member 204 in the width direction of the fixing belt 102 may be suppressed.

Furthermore, in the fixing device 200, the coil springs 212 cause the contact member 204 to follow the fixing belt 102 in a movement independently of the steering roller 106. Accordingly, in the fixing device 200, compared to the structure in which the contact member is swung integrally with the steering roller, variation in contact state of the contact member 204 in the width direction of the fixing belt 102 may be suppressed.

Furthermore, in the fixing device 200, the sum of the largest value of the urging force applied by the coil springs 212 (arrow Fs) and the vector value of the mass of the contact member 204 (arrow Fg; according to the present exemplary embodiment, the vertical component Fgv of the mass of the contact member 204 with respect to the fixing belt 102) is smaller than or equal to the tension (arrow Ft) of the fixing belt 102. Thus, the fixing belt 102 is smoothly rotated while the projection 110B of the contact member 204 is pressed against the inner circumferential surface of the fixing belt 102 by the coil springs 212. Accordingly, in the fixing device 200, compared to the case where the sum of the urging force applied by the urging device and the mass of the contact member is larger than the tension of the fixing belt, variation in contact state of the contact member 204 in the width direction of the fixing belt 102 may be suppressed.

Furthermore, in the fixing device 200, the contact member 204 is pressed against the inner circumferential surface of the fixing belt 102 due to the urging force applied by the coil springs 212 with the guides 222 inserted into the holes 206 of the contact member 204. This regulates the movement of the contact member 204 in directions other than the urging direction of the coil springs 212. Thus, independently of a direction in which the steering roller 106 is swung, the contact member 204 may be easily moved such that the contact member 204 follows the inclination of the fixing belt 102. Accordingly, in the fixing device 200, compared to a structure in which the contact member is moved in directions other than the urging direction applied by the urging device, deviation in position of the fixing belt 102 in the rotating direction may be suppressed.

Supplemental Description

The fixing device according to any of the first to third exemplary embodiments is provided with the support device 140, 160, 170 that causes the contact member 110 to be swung about the central portion of the contact member 110 in the width direction of the contact member 110. However, the present disclosure is not limited to this. For example, the support device may cause the contact member serving as the example of the contact unit to be swung about any part of the contact member in the longitudinal direction of the contact member. In the fixing device according to any of the first to third exemplary embodiments, the contact member 110 is not necessarily to be swung. The contact member 110 may be moved in a direction intersecting the fixing belt 102.

In the fixing device according to any of the first to third exemplary embodiments, the position of neither the shaft 142 for the swing of the contact member 110 nor the rotation shaft 124 for the inclination of the steering roller 106 is limited to the central portion in the width direction of the contact member 110 or the steering roller 106. These positional relationships are able to be changed. In so doing, the shaft for the swing of the contact member 110 and the rotation shaft for the inclination of the steering roller 106 may be disposed one above the other in the virtual plane. The shaft for the swing of the contact member 110 and the rotation shaft for the inclination of the steering roller 106 may be disposed one above the other in the virtual plane that passes through the center of the shaft for the swing of the contact member 110. The center of the rotation shaft for the inclination of the steering roller 106 may be disposed in the virtual plane that passes through the center of the shaft for the swing of the contact member 110.

According to the first to fourth exemplary embodiments, the steering roller 106 is swung about the central portion 106C of the steering roller 106 in the axial direction (that is, the axis of the rotation shaft 124). However, the present disclosure is not limited to this. For example, one end portion of the steering roller 106 in the axial direction of the steering roller 106 may be fixed. In this case, the other end portion of the steering roller 106 is swung. Furthermore, the rotation shaft is not necessarily provided, and cams may be provided on both sides of the steering roller 106 in the width direction of the steering roller 106. In this case, the inclination of the steering roller is changed by rotation of the cams.

Although the present disclosure is applied to the fixing device 20, 220 according to the first to fourth exemplary embodiments, the present disclosure is not limited to this. The present disclosure may be applied to a belt-type transport device other than the fixing device. For example, the present disclosure may be applied to a transfer device or the like that includes a belt to be rotated.

Although the heaters 114 that heat the fixing belt 102 are provided in the fixing device 20, 220 according to the first to fourth exemplary embodiments, the present disclosure is not limited to this. For example, the pressure unit in contact with the fixing belt 102 may be heated.

Although the present disclosure has been described in detail with the specific exemplary embodiments, the present disclosure is not limited to these exemplary embodiments. It is obvious to one skilled in the art that various other exemplary embodiments are possible within the scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A belt-type transport device comprising:

an endless belt that has an outer circumferential surface and an inner circumferential surface and that is to be rotated;

a pressure unit in contact with the outer circumferential surface of the belt;

a nip forming unit that presses the belt against the pressure unit so as to form a nip through which a recording medium is to be transported;

a belt stretching roller that is disposed inside the belt and that stretches the belt;

an inclination controller that controls inclination of an axis of rotation of the belt stretching roller;

a contact unit that is provided along a width direction of the belt and that is in contact with the inner circumferential surface of the belt; and a support unit that supports the contact unit such that the contact unit is able to follow inclination of the belt which is changed due to the inclination of the belt stretching roller.

2. The belt-type transport device according to claim 1, wherein the inclination controller swings the belt stretching roller, and wherein the support unit causes the contact unit to follow the belt in a movement independently of the belt stretching roller.

3. The belt-type transport device according to claim 2, wherein the support unit swings the contact unit about a portion of the contact unit in a longitudinal direction of the contact unit.

4. The belt-type transport device according to claim 3, wherein the support unit swings the contact unit about a central portion of the contact unit in the longitudinal direction of the contact unit.

5. The belt-type transport device according to claim 4, wherein the support unit includes a shaft about which the contact unit is swung, and wherein the shaft extends in a direction intersecting the longitudinal direction of the contact unit.

6. The belt-type transport device according to claim 5, further comprising:

a rotation shaft for the inclination of the belt stretching roller, wherein the shaft and the rotation shaft are disposed one above another in a section taken along a virtual plane.

7. The belt-type transport device according to claim 3, wherein the support unit includes a shaft about which the contact unit is swung, and wherein the shaft extends in a direction intersecting the longitudinal direction of the contact unit.

8. The belt-type transport device according to claim 7, further comprising:

a rotation shaft for the inclination of the belt stretching roller, wherein the shaft and the rotation shaft are disposed one above another in a section taken along a virtual plane.

9. A fixing device comprising:

the belt-type transport device according to claim 1; and a heating unit that heats at least one of the belt and the pressure unit, wherein the recording medium on which a toner image has been formed is transported to the nip so as to fix the toner image to the recording medium.

10. An image forming apparatus comprising:

the fixing device according to claim 9; and a transport unit that transports the recording medium on which the toner image has been formed to the nip of the fixing device.

11. An image forming apparatus comprising:

the belt-type transport device according to claim 1; and a transport unit that transports the recording medium to the nip of the belt-type transport device.

12. A belt-type transport device comprising:

an endless belt that has an outer circumferential surface and an inner circumferential surface and that is to be rotated;

a pressure unit in contact with the outer circumferential surface of the belt;

a nip forming unit that presses the belt against the pressure unit so as to form a nip through which a recording medium is to be transported;

a belt stretching roller that is disposed inside the belt and that stretches the belt;

an inclination controller that controls inclination of the belt stretching roller;

a contact unit that is provided along a width direction of the belt and that is in contact with the inner circumferential surface of the belt; and a support unit that supports the contact unit such that the contact unit is able to follow inclination of the belt which is changed due to the inclination of the belt stretching roller, wherein the support unit swings the contact unit about a portion of the contact unit in a longitudinal direction of the contact unit.

13. The belt-type transport device according to claim 12, wherein the support unit swings the contact unit about a central portion of the contact unit in the longitudinal direction of the contact unit.

14. The belt-type transport device according to claim 13, wherein the support unit includes a shaft about which the contact unit is swung, and wherein the shaft extends in a direction intersecting the longitudinal direction of the contact unit.

15. The belt-type transport device according to claim 14, further comprising:

a rotation shaft for the inclination of the belt stretching roller, wherein the shaft and the rotation shaft are disposed one above another in a section taken along a virtual plane.

16. The belt-type transport device according to claim 12, wherein the support unit includes a shaft about which the contact unit is swung, and wherein the shaft extends in a direction intersecting the longitudinal direction of the contact unit.

17. The belt-type transport device according to claim 16, further comprising:

a rotation shaft for the inclination of the belt stretching roller, wherein the shaft and the rotation shaft are disposed one above another in a section taken along a virtual plane.

18. A belt-type transport device comprising:

an endless belt that has an outer circumferential surface and an inner circumferential surface and that is to be rotated;

a pressure unit in contact with the outer circumferential surface of the belt;

a nip forming unit that presses the belt against the pressure unit so as to form a nip through which a recording medium is to be transported;

a belt stretching roller that is disposed inside the belt and that stretches the belt;

an inclination controller that controls inclination of the belt stretching roller;

a contact unit that is provided along a width direction of the belt and that is in contact with the inner circumferential surface of the belt;

a support unit that supports the contact unit such that the contact unit is able to follow inclination of the belt which is changed due to the inclination of the belt stretching roller; and an urging device that urges the contact unit toward the inner circumferential surface of the belt, wherein a sum of an urging force applied by the urging device and mass of the contact unit is smaller than or equal to tension of the belt.

19. The belt-type transport device according to claim 18, further comprising:

a regulator that regulates movement of the contact unit in directions other than a direction in which the urging device urges the contact unit.

* * * * *